US006384709B2

(12) United States Patent
Mellen et al.

(10) Patent No.: US 6,384,709 B2
(45) Date of Patent: May 7, 2002

(54) ACCESS CONTROL SYSTEM FOR MOBILE PLATFORM USING ELECTRONIC KEY-EMBEDDED LOCATION VERIFICATION DATA

(75) Inventors: Michael Mellen; James E. Disbrow, both of Palm Bay; William E. Wagner, Satellite Beach; James Roesch; Carl Finney, both of Melbourne, all of FL (US)

(73) Assignee: Intellikey Corporation, Melbourne, FL (US)

( * ) Notice: Subject to any disclaimer, the term of this patent is extended or adjusted under 35 U.S.C. 154(b) by 0 days.

(21) Appl. No.: 09/776,569

(22) Filed: Feb. 2, 2001

Related U.S. Application Data

(63) Continuation of application No. 09/088,467, filed on Jun. 1, 1998, now abandoned.

(60) Provisional application No. 60/047,377, filed on Jun. 2, 1997, and provisional application No. 60/048,123, filed on May 30, 1997.

(51) Int. Cl.[7] ..... E05B 49/00

(52) U.S. Cl. ..... 340/5.2; 342/457; 701/35

(58) Field of Search ..... 340/5.2, 5.5, 5.27, 340/5.21, 5.28, 5.7, 5.73, 5.72, 5.63, 825.49, 825.27, 825.37; 70/267, 278.1, 278.2; 342/457, 357.09, 357.08; 701/35, 213

(56) References Cited

U.S. PATENT DOCUMENTS

| | | | | |
|---|---|---|---|---|
| 4,750,197 | A | 6/1988 | Denekamp et al. | 679/58 |
| 4,766,746 | A | 8/1988 | Henderson et al. | 70/63 |
| 5,337,588 | A | 8/1994 | Chhatwal | 70/278 |
| 5,648,763 | A | 7/1997 | Long | 340/825.49 |
| 5,705,991 | A | 1/1998 | Kniffin et al. | 340/825.31 |

*Primary Examiner*—Michael Horabik
*Assistant Examiner*—William L Bangachon
(74) *Attorney, Agent, or Firm*—Allen, Dyer, Doppelt, Milbrath & Gilchrist, P.A.

(57) ABSTRACT

An access control system prevents a mobile container from being compromised/opened during transit, through the use of a programmable electronic lock, which can be unlocked only by means of an enabled electronic key that has been programmed with geographical location data representative of the destination site of the container. When the mobile container arrives at its destination, the key is coupled with a comparator, which compares the geographic location information in the key with real time geographic location information from a geographic location detection unit associated with the mobile container. In response to a match, the comparator enables the key for a prescribed period of time. The key may then be inserted into the programmable electronic lock, which reads the key to determine whether it has been enabled. If the key is enabled, the lock can be unlocked, to provide access to the container.

12 Claims, 2 Drawing Sheets

ACCESS CONTROL SYSTEM FOR MOBILE PLATFORM USING ELECTRONIC KEY-EMBEDDED LOCATION VERIFICATION DATA

CROSS-REFERENCE TO RELATED APPLICATIONS

The present application is a continuation of and claims the benefit of non-provisional U.S. patent application Ser. No. 09/088,467, now abandoned, entitled: "Access Control System for Mobile Platform Using Electronic Key-Embedded Location Verification Data," filed Jun. 1, 1998, by M. Mellen et al, assigned to the assignee of the present application, and which claims the benefit of previously filed provisional U.S. Patent Application Serial No. 60/048,123, filed May 30, 1997 and provisional U.S. Patent Application Serial No. 60/047,377, filed Jun. 2, 1997, each provisional application being entitled: "Site Verification Access Control," and being assigned to the assignee of the present application, and the disclosures of which are incorporated herein. In addition, the present application relates to subject matter disclosed in non-provisional U.S. patent application Ser. No. 09/088,468, now U.S. Pat. No. 6,092,404, filed Jun. 1, 1998, entitled: "Electronically Actuated Cargo Door Lock Assembly," by K N Singh Chhatwal (hereinafter referred to as the '404 patent), assigned to the assignee of the present application and the disclosure of which is incorporated herein.

FIELD OF THE INVENTION

The present invention is directed to an access control system for a mobile platform, such as a transportation vehicle (e.g., aircraft, trailer truck), cargo container, and the like, and which is operative to prevent access to or operation of the mobile platform, unless the platform has been transported to a prescribed geographical location. Security access control is effected by means of an electronic lock, which can be unlocked only by means of an enabled programmable electronic key containing destination geographical location data. To enable the electronic key, its stored location data must be verified by a geographical position detection system associated with the mobile platform.

BACKGROUND OF THE INVENTION

One of the most prevalent of what are often (erroneously) referred to 'victimless' crimes is cargo theft. Worldwide industry theft losses for cargo theft in 1995 were approximately $470 billion, and an additional $400 billion was lost to a multitude of cunning and deceptive fraud schemes. Between hijackings and internal fraud, the cost to business has reached such epidemic proportions, that the insurance industry has estimated that cargo theft losses now account for $150 of the retail price of every personal computer. As a consequence, insurance premiums and deductibles are rising at an alarming rate. While insurance company payouts can replace stolen goods, the loss of business from clients forced to buy from someone else might never be replaced. Also, even though enforcement agencies have begun forming task forces to deal with the problem, most of their responses have been reactive rather than proactive; law enforcement and private industry have realized that they must work together to solve the problem.

For this purpose, a very basic procedure has been to simply lock the doors of cargo containers and vehicles; however, such locking of truck/cargo carriers has not provided adequate protection, as industry experts point out as much as 80% of cargo theft is the result of insiders with keys to the truck/carrier storage units. It has been concluded that the only effective measure to secure cargo is to employ a measure that will assure that the truck or carried storage unit cannot be opened between its departure location and its intended destination.

One proposal to address this problem, described in the Long U.S. Pat. No. 5,648,763, is to equip the cargo container/vehicle with a geographical position detection unit (such as a Global Positioning System (GPS)-based unit) that is directly connected to the locking mechanism for the container, and prevents the container's locking system from being compromised/opened during transit. For this purpose, the geographical position detection unit functions to maintain the security access control system for the container (a solenoid-driven lock) in a locked or secure state, until it detects that the container has arrived at its intended destination. At this point, the geographical position detection unit issues an unlock signal to the locking mechanism and allow access to the container.

A fundamental shortcoming with of approach is the fact that the security access control system and its associated geographical position detection equipment (such as a Global Positioning System (GPS)-based unit), which may typically be installed in or adjacent to the cab of a truck, or within the container proper where the cargo is stored, is directly linked with the hardware of the mechanical locking unit for the vehicle/cargo container doors at the rear of the truck. The fact that the two are directly linked through or along the confines of the truck where cargo is stored, and the substantial physical separation therebetween creates the potential for damage or compromise of the control link between the security access control unit and the lock. In addition, in the patented system, all of the security access control information, including the critical geographical location information, is programmed into the security access control system. Since the security access control system is resident in equipment permanently installed in the container/vehicle, programming the geographical location information must be physically carried out 'in the truck'.

SUMMARY OF THE INVENTION

In accordance with the present invention, these drawbacks are effectively obviated, and additional security and functionality are provided by means of a new and improved geographical position-based electronic lock and key system. This system contains a programmable electronic lock which can be unlocked only by means of a programmable electronic key, into which geographical location data of the destination site of interest has been programmed externally of the mobile platform, such as a tractor trailer cargo enclosure, and which remains disabled until it has been verified that the mobile platform has arrived at its destination site.

Once the mobile platform has arrived at its destination site, the electronic key is inserted into a location verification comparator unit, that is coupled to a geographical position detection system for the mobile platform. If the two sets of geographical location data match, the key becomes enabled for a prescribed interval of time (e.g., five minute), that allows it to operate the electronic lock and thereby provide access to the container/vehicle. Providing such a time-limited enabling of the key prevents a driver from obtaining an enabled key at the authorized destination site and then driving the vehicle to another illegal location and opening and unloading the cargo container at that point.

Preferably, the electronic lock and key are of the type described in U.S. Pat. Nos. 5,337,588 and 5,625,349

(hereinafter referred to as the '588 and '349 patents, respectively), each containing its own individually programmable control processor, and employing encrypted, scrambled (opto-electronic) communications for increased security.

The security access control system includes a geographical position detection subsystem, such as, but not limited to a Global Positioning System (GPS)-based, LORAN-based or other equivalent navigation—geographical coordinate locating unit, to which a position location subsystem receiver is coupled. The subsystem is preferably installed in or adjacent to the cab of the truck, so that it is physically isolated from the cargo container, and therefore not subject to being impacted or otherwise affected by the contents of the cargo container.

The GPS receiver is coupled to supply geographic coordinate position data to an electronic key-receiving interface, that contains a keyway configured to provide communication capability with a programmable electronic key. The keyway and the GPS receiver are coupled to a signal processing unit that includes microprocessor, digital and analog signal processing components of the electronic lock and key system described in the above-referenced '349 patent. The interface reads geographical position data provided in real time by the GPS receiver, which is compared with the geographical position data stored in memory of the programmable key.

Writing geographical location data into a key is carried out using a further electronic key-receiving interface associated with digital terminal equipment located at a transportation control site, such as a point of origin supervisory dispatch center. Like the interface of the GPS receiver signal processing subsystem within the container transport vehicle, the key-programming interface contains a keyway provides communication capability between the programmable electronic key and a control processor, through which a terminal operator may program prescribed access control information into a key that has been inserted into the terminal equipment's interface.

Through his terminal, the dispatch operator may program one or more of permission use parameters described in the '349 patent, and also enter geographical position data associated with the destination location of the cargo container, access to which is to be controlled by the key being programmed. Once the container is closed and locked, it cannot be reopened until it has reached its destination location, and the security access control system on board the mobile platform has verified that the geographical position data from the associated GPS receiver at that location effectively corresponds to what has been programmed into the memory of the electronic key at the transportation dispatch site.

This geographical location-based enabling of the key may be optionally supplemented by one or more secondary parameters, such as date, user/driver identification data, etc., that may be entered by an auxiliary input/output device (e.g., keypad) associated with the GPS receiver.

Since the electronic lock need only detect that the key has been enabled to operate the lock, it does not need to be connected to the site verification electronics, allowing the locking assembly can be a stand-alone item, that is physically isolated from the cargo container, and therefore not subject to being directly impacted or otherwise affected by any potential shifting of the contents of the cargo container. This isolation and autonomous operation of the lock allows the lock's electronic circuitry to be installed in a protected environment at the inside of an access door to the container. It also allows the keyway cylinder to be retained within in a highly ruggedized locking assembly housing mounted to the exterior of the access door, and readily engaging a door latching mechanism, such as a transportation industry standard J-hook latch.

DETAILED DESCRIPTION

Figure 1:
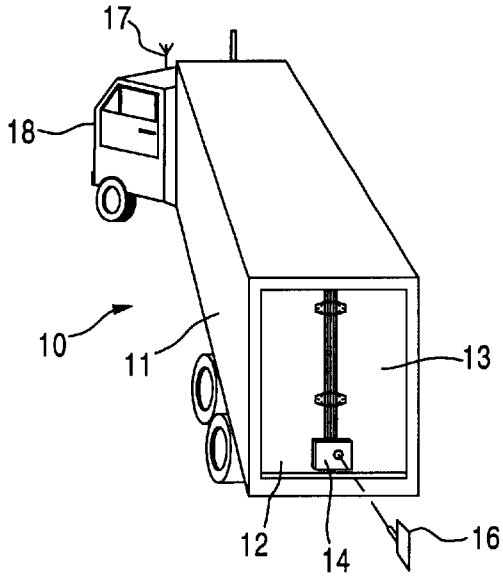
FIG. 1 illustrates a mobile transportation platform (trailer truck) in which a geographical position-based electronic lock and key system of the present invention may be installed.

Before describing in detail the geographical position-based electronic lock and key system of the invention, it should be observed that the invention resides primarily in what is effectively an integration of a conventional geographical position location subsystem, such as but not limited to a GPS-based unit, with an electronic lock and key subsystem of the type described in the above-referenced '588 and '349 patents, that provides for individual programming of the electronic key, using conventional communication circuits and associated interface components.

Consequently, the configuration of such circuits and components and the manner in which they are interfaced with other communication network equipment have, for the most part, been illustrated in the drawings by readily understandable block diagrams, which show only those specific details that are pertinent to the present invention, so as not to obscure the disclosure with details which will be readily apparent to those skilled in the art having the benefit of the description herein. Thus, the block diagram illustrations are primarily intended to show the major components of the system in a convenient functional grouping, whereby the present invention may be more readily understood.

For purposes of providing a practical, but non-limiting example, respective steps of the invention illustrated in the flow chart of FIG. 4 will be described in the context of a security or locking system (provided at step 401 in the flow chart of FIG. 4) for a container 11 transported by a trailer truck 10, as diagrammatically illustrated in FIG. 1. It is to be understood however, that the mobile cargo platform with which the invention may be employed could be any of a variety of ground, marine or air-based mobile platforms. In the illustrated example, the container 11 comprises a tractor trailer cargo enclosure, access to which may be provided by conventional side or rear doors, such as the shown pair of hinged rear doors 12 and 13, a hinged side doors, a roll-up rear door, as customarily used with cargo storage containers.

The doors are locked in their closed position by a door-locking mechanism 14, in which an electronic lock 15 that is unlocked by means of an electronic key 16 is installed. As noted above, as a non-limiting example, each of the electronic lock 15 and key 16 is preferably of the type described in the above-referenced '588 and '349 patents; also, the electronically actuated cargo door lock assembly 14 is preferably configured in the manner described in the '404 patent.

The security access control system of the mobile platform of FIG. 1 further includes a geographical position detection subsystem (such as, but not limited to a Global Positioning System (GPS)-based, LORAN-based or other equivalent navigation—geographical coordinate locating unit). This geographical position detection subsystem includes an antenna 17, to which a geographical location subsystem receiver (such as a GPS receiver) is coupled. The subsystem may be installed in or adjacent to the cab 18 of the truck 10, so that it is physically isolated from the cargo container 11, and therefore is not subject to being directly impacted or otherwise affected by the cargo contents of the container 11.

Alternatively, the geographical position detection subsystem need not be located on-board the mobile platform (truck), but can be installed at the destination site (e.g., a cargo delivery depot). This configuration would provide a cost savings to the customer, since the number of geographical position detection subsystems could be reduced to one per destination, rather than one per truck.

Figure 2:
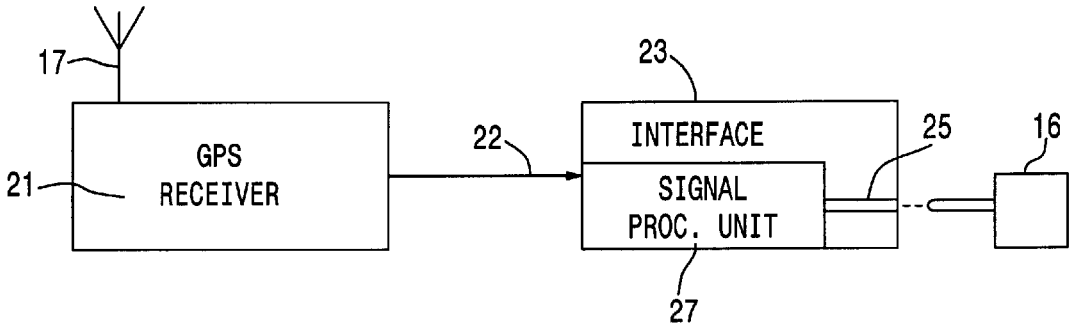
FIG. 2 diagrammatically illustrates the architecture of a mobile platform-installed geographical position-based electronic lock and key system in accordance with the invention.
Figure 4:
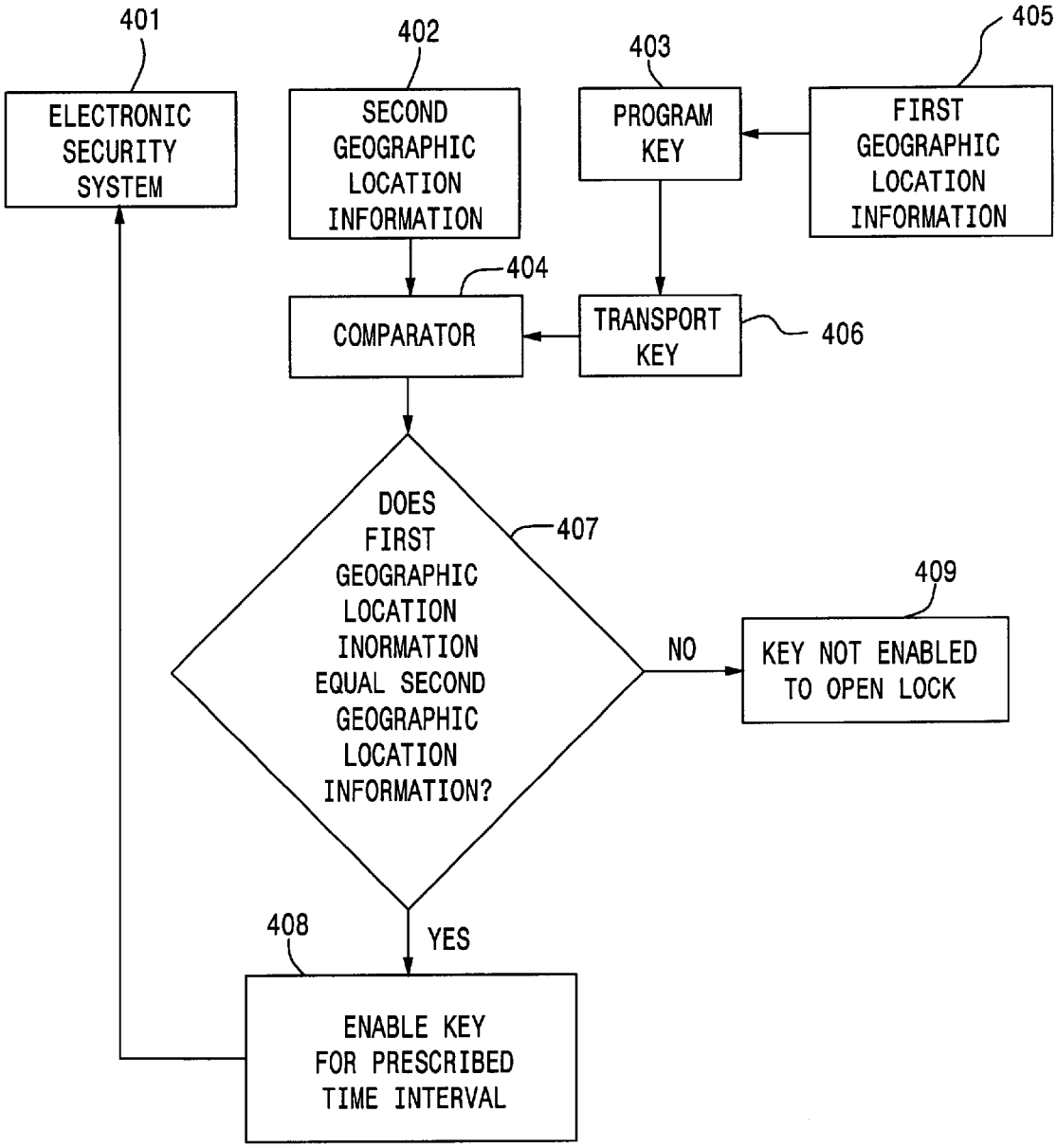
FIG. 4 is a flow chart showing steps carried out in accordance with the operation of the geographical position-based electronic lock and key system of the invention.

As shown in the signal processing architecture diagram of FIG. 2, the GPS receiver 21 is coupled to supply geographic coordinate position data (shown as second geographic location information in step 402 of the flow chart of FIG. 4) over a communication link 22 to an electronic key-receiving interface 23. Interface 23 contains a keyway 25, which is configured to provide communication capability with the programmable electronic key 16 provided at step 403 of the flow chart of FIG. 4. The keyway 25 and the communication link 22 are coupled to a signal processing unit 27 that includes microprocessor, digital and analog signal processing components of the electronic lock and key system described in the above-referenced '349 patent. For this purpose, the communication link 22 may be coupled to the digital communication port of the digital application specific integrated circuit (ASIC) of the circuitry shown in FIG. 1 of the '349 patent. It is through this digital communication port that the interface reads geographical position data as provided in real time by the GPS receiver 21, so that it may be compared (in step 404 of the flow chart of FIG. 4) with the geographical position data (shown as first geographic location information in step 405 of the flow chart of FIG. 4) that has been written into memory of the programmable processor within the key 16.

Figure 3:
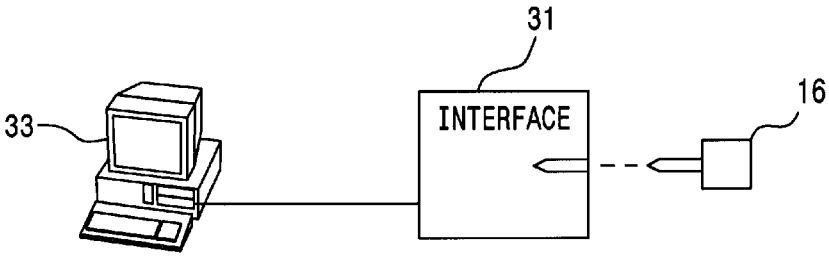
FIG. 3 diagrammatically illustrates a geographical position-programming unit for programming an electronic key employed in the system of FIG. 2.

The writing of geographical location data into an electronic key may be readily accomplished by means of a further electronic key-receiving interface, such as that shown at 31 in the key programming architecture of FIG. 3. Interface 31 is coupled to digital terminal equipment (DTE) 33 located at a transportation control site, such as a point of origin supervisory dispatch center. Like the interface 23 of the GPS receiver signal processing subsystem that is installed within the container transport vehicle, interface 31 contains a keyway configured to receive and provide communication capability with programmable electronic key 16. Interface 31 includes microprocessor, digital and analog signal processing components of the electronic lock and key system described in the '349 patent, through which a terminal operator may program prescribed access control information into a key that has been inserted into the terminal interface keyway, in the manner described therein.

In addition to the ability to program one or more of the permission of use parameters described in the '349 patent, the dispatch operator has the ability to enter geographical position data associated with the destination location (e.g., geographical coordinates) of the container, access to which is to be controlled by the key being programmed. This means that once the container is closed and locked, it cannot be reopened until it has reached its destination location, and the security access control system on board the mobile platform has verified that the geographical position data being generated by its associated GPS receiver at that location (to which the programmed key has been transported, as shown at step 406 in the flow chart of FIG. 4) effectively corresponds to what has been programmed into the memory of the electronic key at the transportation dispatch site.

In accordance with the inventive key enabling control software employed by the microprocessor of the GPS receiver interface 23, in response to a favorable comparison (to within some bit offset or error window) between the two sets of geographical location data (one-real time data supplied by the geographical location subsystem, and the other programmed destination data), namely, the answer to query step 407 in the flow chart of FIG. 4 is YES, the microprocessor writes a prescribed set of 'permission' data to the key 16, which 'enables' or 'activates' the key (i.e., grants the key the ability to operate the electronic lock 15 within the door-locking mechanism 14) for a prescribed period time (e.g., five minutes, as a non-limiting example), shown by step 408 in the flow chart of FIG. 4. Otherwise (the answer to query step 407 is NO, the key is not enabled, as shown at step 408 in the flow chart of FIG. 4.

As pointed out above, limiting the time that the key is enabled serves to prevent a driver from obtaining an enabled key at the authorized destination site and then driving the vehicle to another illegal location and opening and unloading the cargo container at that point. The geographical location-based enabling of the electronic key 16 may be optionally supplemented by one or more secondary parameters, such as date, user/driver identification data, etc., that may be entered by an auxiliary input/output device (e.g., keypad) associated with the GPS receiver 21.

Once the key 16 has been enabled and is inserted within the keyway of the electronic lock 15, it conducts an information message exchange with the lock in the manner described in the '349 patent. The lock's microprocessor reads the parameters of the keys' permission information field to determine if the key has been enabled and may operate the lock. Advantageously, the lock's processor need not have any knowledge of what gives the key the right to access the lock (here the fact that the container has been delivered to its intended destination); it only needs to find 'permission-granted' status written to the key.

This means that the locking assembly can be a stand-alone item, and does not require a connection to or information supplied by the geographical position detecting subsystem, which, as described above, is preferably physically isolated from the cargo container, and therefore not subject to being directly impacted or otherwise affected by the (shifting of the) contents of the cargo container. This separation and autonomous operation of the lock allows the lock's electronic circuitry to be installed in a protected environment at the inside of an access door to the container. It also allows the keyway cylinder to be retained within in a highly ruggedized locking assembly housing mounted to the exterior of the access door, and readily engaging a door latching mechanism, such as a transportation industry standard J-hook latch. For this purpose, as pointed out above, the lock housing assembly components preferably have a configuration of described in the '404 patent.

As will be appreciated from the foregoing description, through the use of a programmable electronic lock, which can be unlocked only by means of a programmable electronic key containing geographical location data that relatively precisely (using GPS-defined coordinates) identifies the destination site of cargo delivery, the access control system of the present invention not only prevents the container's locking system from being compromised/opened during transit, but does so in a manner that effectively isolates the geographical position detection equipment and site verification electronics from the container proper, where cargo that is subject to shifting is stored.

This decoupling of the site verification electronics from the hardware of the mechanical locking unit for the vehicle/cargo container doors serves to minimize the potential for damage to the site verification electronics and avoids the need for installing a control link (that is subject to being compromised by the contents of the cargo enclosure) between the security access control unit and the lock. In addition, since the security access controlling geographical location is resident in the key, rather than into the site verification electronics subsystem within the vehicle, programming the system (via the key) is readily accomplished without having to physically gain access to the mobile platform (the truck).

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein, but intend to cover all such changes and modifications as are obvious to one of ordinary skill in the art.

What is claimed is:

1. A method for controlling access to a mobile platform, which is to travel from a starting location to a prescribed destination, where access to said mobile platform is to be provided, said method comprising the steps of:

(a) programming an initially disabled electronic key that is to travel with said mobile platform with first geographic location information representative of said prescribed destination of said mobile platform;

(b) providing a comparator which is coupled to receive second geographic location information representative of the geographic location of said mobile platform, and is capable of reading said first information that has been programmed into said electronic key;

(c) providing an electronic security device through which access to said mobile platform is controllably provided, said security device including an electronic lock, which can only be operated by an electronic key that has been enabled to operate said electronic lock, said electronic security device receiving no geographic location information for its operation, and being decoupled from any device that stores geographic location information, exclusive of an electronic key coupled thereto;

(d) transporting said mobile platform and said electronic key therewith to said prescribed destination;

(e) in association with said mobile platform arriving at said prescribed destination, coupling said electronic key, as programmed in step (a), with said comparator, so that said comparator may compare said first geographic location information stored in said programmed electronic key with said second geographic location information;

(f) in response to said second geographic location information effectively corresponding to said first geographic location information stored by said programmed electronic key, causing said comparator to enable said electronic key to operate said electronic lock of said electronic security device, but otherwise maintaining said programmed electronic key disabled;

(g) decoupling said electronic key from said comparator, and engaging said electronic key with said electronic lock of said security device; and (h) in response to said electronic key having been enabled in step (f), causing said electronic key to open said electronic lock of said security device and afford access to said mobile platform, but otherwise maintaining said electronic lock of said security device in a locked condition, so as to prevent access to said mobile platform.

2. The method according to claim 1, wherein step (f) comprises enabling said electronic key to operate said electronic lock of said security device for only a given period of time.

3. The method according to claim 1, wherein said mobile platform comprises a transportation vehicle containing a cargo storage container to which said electronic security device is affixed, and wherein, in step (b), said second geographic location information received by said comparator is sourced from a geographical position detection unit that is decoupled from said electronically operable security device.

4. The method according to claim 3, wherein said geographical position detection unit is situated at a location exclusive of said cargo storage container.

5. A system for controlling access to a mobile platform, which is to travel from a starting location to a prescribed destination, said system comprising:

an electronic security device through which access to said mobile platform is controllably provided, said security device including an electronic lock, which can only be operated by an electronic key that has been enabled to operate said electronic lock, said electronic security device receiving no geographic location information for its operation, and being decoupled fromany device that stores geographic location information, exclusive of an electronic key coupled thereto;

a programming device which is operable to program an initially disabled electronic key with first geographic location information representative of said prescribed destination of said mobile platform;

an electronic key which is configured to be coupled with said programming device and programmed thereby with said first geographic location information, and transported with said mobile platform to said prescribed destination;

a comparator, which is engageable by said electronic key in association with said mobile platform arriving at said prescribed destination, and is operative to compare said first information that has been programmed into said electronic key with second geographic location information representative of the geographic location of said mobile platform and, in response to said second geographic location information effectively corresponding to said first geographic location information stored by said programmed electronic key, to enable said electronic key to operate said electronic lock of said electronic security device and thereby provide access to said mobile platform, but otherwise maintaining said programmed electronic key disabled so as to maintain said electronic lock of said security device in a locked condition, and as to prevent access to said mobile platform.

6. The system according to claim 5, wherein said comparator is operative to enable said electronic key to operate said electronic lock of said security device for only a given period of time.

7. The system according to claim 5, wherein said mobile platform comprises a transportation vehicle containing a cargo storage container to which said electronic security device is affixed, and wherein said second geographic location information received by said comparator is sourced from a geographical position detection unit that is decoupled from said electronically operable security device.

8. The system according to claim 7, wherein said geographical position detection unit is situated at a location exclusive of said cargo storage container.

9. A method for controlling access to a container, which is transported from a first geographic location to a second geographic location, where access to said container is to be provided, said method comprising the steps of:

(a) providing an electronic security device through which access to said container is controllably provided, said security device including an electronic lock, which can be operated only by an electronic key enabled to operate said electronic lock, said electronic security device receiving no geographic location information for its operation, and being decoupled from any device that stores geographic location information, exclusive of an electronic key coupled thereto;

(b) providing an initially disabled electronic key;

(c) programming said initially disabled electronic key with first geographic information representative of said second geographic location;

(d) transporting said container and said electronic key to said second location;

(e) in association with said container having been transported to said second location, comparing said first geographic location information stored in said electronic key as programmed in step (c) with second geographic location representative of the geographic location of said container;

(f) in response to said second geographic location information effectively corresponding to said first geographic location information stored by said programmed electronic key, enabling said electronic key to operate said electronic lock of said electronic security device, but otherwise maintaining said programmed electronic key disabled;

(g) coupling said electronic key with said electronic lock of said security device; and (h) in response to said electronic key having been enabled in step (f), causing said electronic key to open said electronic lock of said security device and provide access to said container, but otherwise maintaining said electronic lock of said security device in a locked condition, so as to prevent access to said container.

10. The method according to claim 9, wherein step (f) comprises enabling said electronic key to operate said electronic lock of said security device for only a given period of time.

11. The method according to claim 9, wherein said container is installed on a transportation vehicle and has said electronic security device affixed thereto, and wherein, in step (e), said second geographic is sourced from a geographical position detection unit that is decoupled from said electronically operable security device.

12. The method according to claim 11, wherein said geographical position detection unit is situated at a location exclusive of said container.

* * * * *